US006910533B2

(12) United States Patent
Guerrero

(10) Patent No.: US 6,910,533 B2
(45) Date of Patent: Jun. 28, 2005

(54) MECHANISM THAT ASSISTS TRACTORING ON UNIFORM AND NON-UNIFORM SURFACES

(75) Inventor: Julio C. Guerrero, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 90 days.

(21) Appl. No.: 10/354,227

(22) Filed: Jan. 29, 2003

(65) Prior Publication Data

US 2003/0183383 A1 Oct. 2, 2003

Related U.S. Application Data

(60) Provisional application No. 60/369,385, filed on Apr. 2, 2002.

(51) Int. Cl.[7] ..... B66F 7/08

(52) U.S. Cl. ..... 166/206; 175/99; 74/103

(58) Field of Search ..... 166/206, 381; 175/98, 99; 74/48, 103, 104, 105

(56) References Cited

U.S. PATENT DOCUMENTS

| | | | | |
|---|---|---|---|---|
| 840,374 A | * | 1/1907 | Rhoades | 74/105 |
| 1,177,984 A | | 4/1916 | Beene | |
| 2,742,259 A | | 4/1956 | Boucher | |
| 2,871,946 A | | 2/1959 | Bigelow | |
| 3,405,772 A | | 10/1968 | Wisenbaker et al. | |
| 3,670,566 A | | 6/1972 | Basham et al. | |
| 3,827,512 A | | 8/1974 | Edmond | |
| 3,862,359 A | | 1/1975 | McCullough et al. | |
| 3,890,905 A | | 6/1975 | Clavin | |
| 3,926,267 A | | 12/1975 | Svirschevsky et al. | |
| 4,031,750 A | | 6/1977 | Youmans et al. | |
| 4,050,384 A | | 9/1977 | Chapman | |
| 4,071,086 A | | 1/1978 | Bennett | |
| 4,095,655 A | | 6/1978 | Still | |
| 4,112,850 A | | 9/1978 | Sigel-Gfeller | |
| 4,177,734 A | | 12/1979 | Rhoden | |
| 4,192,380 A | | 3/1980 | Smith | |
| 4,243,099 A | | 1/1981 | Rodgers, Jr. | |
| 4,272,781 A | | 6/1981 | Taguchi et al. | |
| 4,369,713 A | | 1/1983 | Richardson | |
| 4,372,161 A | | 2/1983 | de Buda et al. | |
| 4,457,236 A | | 7/1984 | Akhmadiev et al. | |

(Continued)

FOREIGN PATENT DOCUMENTS

| | | |
|---|---|---|
| EP | 0564500 B1 | 10/1994 |
| EP | 0964131 A2 | 12/1999 |
| RU | 481748 | 9/1975 |
| WO | WO-95/21987 | 8/1995 |
| WO | WO-98/06927 | 2/1998 |
| WO | WO-99/66171 | 12/1999 |

*Primary Examiner*—William Neuder
(74) *Attorney, Agent, or Firm*—Wayne Kavak; Robin Nava; Tim Curington

(57) ABSTRACT

A six-bar linkage mechanism for conforming to the configuration of a tractored surface having a central link defined by a tool body and a saddle link spaced from the central link and movable for conforming with the tractored surface. A pair of front links each having pivotal connection with respective ends of the saddle link and having linearly movable pivotal connection with the central link to permit angular and spacing changes of the saddle link relative to the central link. A pair of centralizer links are located between the front links and have pivotal connections with the saddle link and pivotal connections with the central link. One of the pivotal connections is linearly movable on the central link. For tractor tools, when the tractored surface is a wellbore or well pipe, a plurality of six-bar linkages radiate from a tool body for surface conforming traction with the tractored surface.

20 Claims, 4 Drawing Sheets

U.S. PATENT DOCUMENTS 4,460,920 A 7/1984 Weber et al.
4,463,814 A 8/1984 Horstmeyer et al.
4,537,136 A 8/1985 Douglas
4,542,869 A * 9/1985 Brine ..... 244/216
4,557,327 A 12/1985 Kinley et al.
4,670,862 A 6/1987 Staron et al.
4,676,310 A 6/1987 Scherbatskoy et al.
4,686,653 A 8/1987 Staron et al.
4,838,170 A 6/1989 Illakowicz
4,862,808 A * 9/1989 Hedgcoxe et al. ..... 104/138.2
4,919,223 A 4/1990 Egger et al.
5,142,989 A 9/1992 Suzumori et al.
5,156,238 A * 10/1992 Matthews ..... 187/243
5,184,676 A 2/1993 Graham et al.
5,293,823 A 3/1994 Box
5,309,844 A 5/1994 Zollinger
5,358,039 A 10/1994 Fordham
5,375,530 A 12/1994 Zollinger et al.
5,375,668 A 12/1994 Hallundbaek
5,513,901 A * 5/1996 Smith et al. ..... 298/22 J
5,794,703 A 8/1998 Newman et al.
5,848,479 A 12/1998 MacIndoe
6,003,606 A 12/1999 Moore et al.
6,089,323 A 7/2000 Newman et al.
6,112,809 A 9/2000 Angle
6,179,055 B1 1/2001 Sallwasser et al.
6,232,773 B1 5/2001 Jacobs et al.
6,241,031 B1 6/2001 Beaufort et al.
6,273,189 B1 8/2001 Gissler et al.
6,427,786 B2 8/2002 Beaufort et al.
6,478,097 B2 11/2002 Bloom et al.

* cited by examiner

MECHANISM THAT ASSISTS TRACTORING ON UNIFORM AND NON-UNIFORM SURFACES

CROSS-REFERENCE TO RELATED APPLICATIONS

This application claims priority from U.S. Provisional Application No. 60/369,385, filed Apr. 2, 2002, which is incorporated herein by reference.

BACKGROUND OF THE INVENTION

1. Field of the Invention

The present invention relates generally to tractoring mechanisms for use in wells. More particularly, the present invention relates to a mechanism that assists tractoring in wells having uniform and non-uniform surfaces by adjusting or adapting its configuration in response to the internal surface configuration of the wellbore, well casing, or pipe through which it is moved. Even more particularly, the present invention is particularly applicable to the field of borehole tractors for conveying logging and service tools in deviated or horizontal oil and gas wells, or in pipelines, where such tools may not readily be conveyed by the force of gravity.

2. Description of Related Art

U.S. Pat. No. 4,557,327 discloses a roller arm centralizer mechanism that is basically in the form of a four-bar mechanism. The disadvantage of this mechanism for tractoring is that the force required to push it through casing joints is several times higher than that required with the six-bar mechanism utilized in the present invention. U.S. Pat. No. 4,243,099 discloses a two-bar mechanism having motor positioned arms with bow springs causing rollers to maintain contact with the borehole wall surface. If used to assist tractoring systems, the rollers of this well tool mechanism will enter casing joints and other depressions and almost always become caught in most casing joints. U.S. Pat. No. 5,358,039 discloses a centralizer mechanism having a non-centered system of four-bar mechanisms with bow springs around them. This system will not allow tractoring systems to pass casing joints and changes of pipe diameter while simultaneously tractoring. U.S. Pat. No. 6,232,773 discloses a tractor vehicle that tows a support vehicle through a flexible coupling. This tractor mechanism employs linkage assemblies in the form of four-bar mechanisms, but does not offer the advantages of the present invention that is based on a six-bar mechanism. U.S. Pat. No. 5,848,479 presents another centralizer option, but does not offer the advantages of the present invention. Finally, the apparatus set forth in U.S. Pat. Nos. 5,794,703 and 5,184,676 are also based on four-bar linkage mechanisms that do not offer the advantages of the present invention.

BRIEF SUMMARY OF THE INVENTION

It is a principal feature of the present invention to provide a novel linkage mechanism that is utilized in conjunction with or as a component of a tractor mechanism to enhance the traction capability of the tractor mechanism when deviations in internal wall surfaces are encountered;

It is another feature of the present invention to provide a novel six-bar type linkage mechanism that offers minimal resistance to movement along the internal surface of a borehole or conduit; and It is also a feature of the present invention to provide a novel six-bar type linkage mechanism that becomes essentially conformed to the internal configuration of the wellbore, well casing, or pipeline that is being traversed and thus maintains an efficient traction capability with the non-uniform internal surface and, after passing an anomaly on the surface, returns to a predetermined configuration for a uniform internal surface.

Briefly, the various principles of the present invention are realized in general by a six-bar linkage mechanism that is employed in conjunction with a tractoring mechanism to assist the tractoring mechanism and other systems to accomplish efficient traction movement within internal surfaces of both uniform and non-uniform surface character. The six-bar linkage mechanism of the present invention is constructed in such a manner that the bars pivot around their joints in order to adapt the linkage mechanism to assume variations in its configuration responsive to the changes of the internal surface geometry in which the system is being utilized to assist or enhance tractoring capability of the systems by maintaining efficient traction contact with the internal surface regardless of its geometric changes.

Specifically, the design relates to logging tools or other tools or devices that are intended to be conveyed through the boreholes of oil and gas wells or conveyed through pipes, such as well casings or pipelines. The present invention may be utilized in conjunction with downhole tractors for well casings in order to facilitate the passage of traction devices and the well tools conveyed thereby over casing joints, restrictions, changes in pipe diameter, and other internal wall surface irregularities in pipes. The six-bar linkage mechanism may also be utilized for traction activity in open-hole wellbores where the density and hardness of the walls allow its utilization. The six-bar linkage mechanism improves other designs and allows the utilization of different types of downhole tractors that otherwise would not be able to move through non-uniform surfaces in casing or open-hole wellbores. The six-bar linkage mechanism of the present invention is also applicable for utilization as a component of a centralizer mechanism for oilfield tools such as logging tools, perforating guns, or other tools that require specific centralized location within a wellbore.

More specifically the six-bar linkage mechanism of the present invention is a combination of interacting mechanical elements that permit the construction of a mechanism or tool that adapts its configuration to the geometric changes of the internal surface against which it slides. For purposes of the present invention, this internal surface is referred to as the tractored surface. The six-bar linkage mechanism of the present invention is constructed in a manner that only three of the mechanism bars can be in contact with the surface at any time.

The mechanism is composed of six main links. One of the links, the central link, is connected to four of the other links at four different joints. Three of these four links can pivot around their joints with the central link and can also slide along the central link. One of these four links can only pivot around its joint with the central link, but cannot slide along it. The remaining link is called a saddle link. The saddle link is connected to the four links that are also connected to the central link. It should be borne in mind, however, that the saddle link is connected to these four links in a different way. Two links of these four are connected to the saddle link at two different points that are close to the saddle link ends. These two links are called front links, they can pivot around their joints with the saddle link. The other two links of the four previously mentioned are connected at a common point with the saddle link, these two links are called the centralizer links. One of the centralizer links can only pivot around its joint with the central link and the other cannot only pivot, but can also slide in its joint with the central link.

When the centralizer links are pivoted around their joints with the central link the saddle link moves toward the tractored surface. For some types of tractored surfaces, the movement of the centralizer links, just described, can also put the front links in contact with the tractored surface. Once the saddle link is in contact with the tractored surface, a force applied along the axis of the central-link can move the whole mechanism along the tractored surface while adapting its configuration to the internal surface geometry. The most efficient of its configurations is a configuration that locates its saddle link in parallel relation with the central link. When the mechanism faces irregular tractored surfaces, the saddle link conforms generally to the internal surface configuration of the tractored surface and is not oriented in parallel relation with the central link. However, the linkage mechanism adapts its configuration to the irregularities of the internal tractored surface until it passes the irregularities, and then the saddle link returns to its original orientation and becomes parallel to the central link again. The major elements of the invention are schematically shown in FIG. 1. In this figure, the parts of the design are labeled according to the description presented in the present section.

BRIEF DESCRIPTION OF THE DRAWINGS

The present invention may be understood by reference to the following description taken in conjunction with-the accompanying drawings in which.

DETAILED DESCRIPTION OF THE INVENTION

Figure 1:
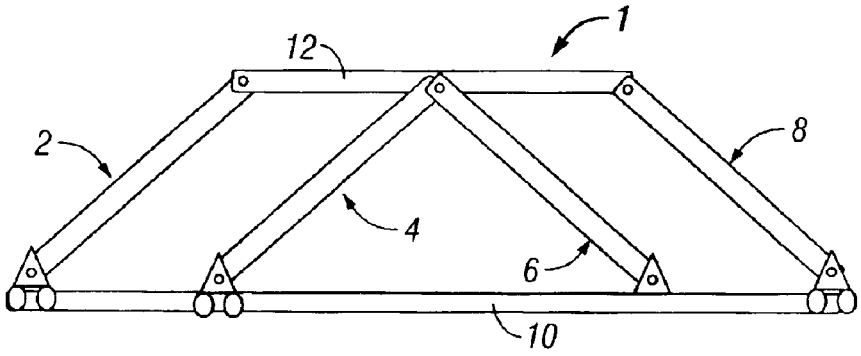
FIG. 1 is a schematic illustration showing the principal components of the invention, with labeling to identify the components.
Figure 2:
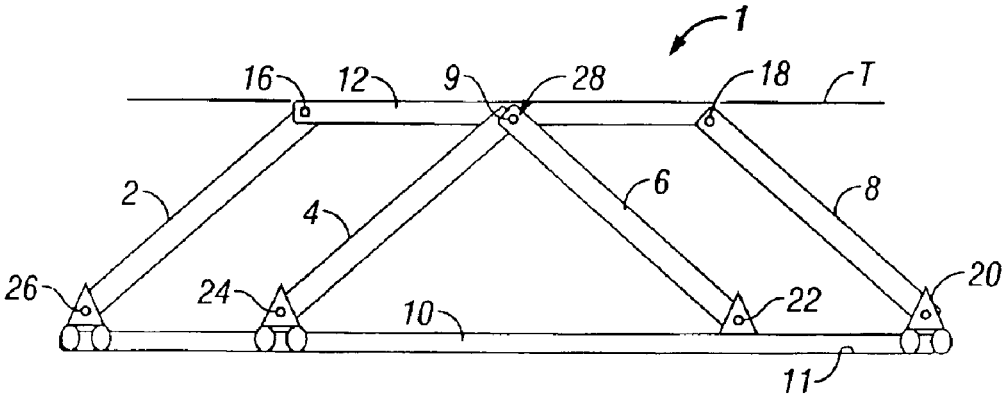
FIG. 2 is a schematic illustration showing the principal components of the invention and is marked with reference numerals for further explanation.

Referring now to the drawings and first to FIGS. 1 and 2, a six-bar linkage mechanism constructed according to the principles of the present invention is shown generally at 1 and incorporates a pair of centralizer links 4 and 6 each having upper and lower ends with the upper ends thereof being connected to a saddle link 12 and the lower ends thereof connected to a central link 10. Though the centralizer links and the central link may be of any desired configuration, depending upon the tool mechanism with which they are associated, for purposes of explanation, they, and other links of the six bar linkage mechanism, are shown as elongate substantially straight members. The centralizer link 6 is pivotally connected to the central link 10 and thus can only pivot with respect to the central link 10 around a pivot joint 22 having a pivot that is fixed to the central link 10 at a point intermediate the extremities of the central link 10. Thus, the pivot joint 22 is referred to herein as a fixed pivot joint, meaning that the pivot of the joint is intended to be substantially immovable relative to both the centralizer link 6 and the central link 10. The centralizer link 4 has its upper end pivotally connected with the saddle link 12 at a point on the saddle link 12 intermediate its ends and has its lower end pivotally connected with a movable or sliding pivot joint 24 that is movable linearly along the central link 10. Thus, the centralizer link 4 can pivot with respect to its pivotal connection with the saddle link 12 and can pivot around a movable or sliding pivot joint 24 that is movable substantially linearly along the central link 10, sliding, rolling or being guided, such as by a guide track or groove that is defined by or provided on the central link 10. The sliding pivot joint 24 of the lower end of centralizer link 4 can also slide, i.e., move linearly with respect to the central link 10 at the sliding pivot joint 24, while maintaining a specific relationship with the central link 10. Typically, this specific linearly movable relationship of each of the sliding pivot joints mentioned herein will be maintained by an elongate, substantially straight guide track 11 that is followed by the sliding pivot joint. The sliding pivot joint is shown to have rollers or guide wheels, but such is not intended to limit the scope of the present invention. Any mechanism that causes the sliding pivot joint to be guided during substantially linear movement along a portion of the central link 10 is intended to be encompassed within the scope of the present invention. The upper ends of the centralizer links 4 and 6 can pivot with respect to the saddle link 12 around a fixed pivot joint 28 that is located intermediate the ends of the saddle link 12. Typically, the upper ends of the centralizer links 4 and 6 will be connected to the central portion of the saddle link 12 by a single pivot pin 9, which establishes the fixed pivot joint 28 and provides for pivotal rotation of the upper ends of centralizer links 4 and 6 with respect to the intermediate portion of the saddle link 12. However, any other suitable pivotal mount may be used to establish pivotal connection of the upper ends of the centralizer links 4 and 6 with the intermediate portion of the saddle link 12. A front link 2 is pivotally connected to one end of the saddle link 12 at a pivot joint 16 having a pivot that is fixed with respect to one end of the saddle link 12. The front link 2 is thus rotatable about its pivotal connection with respect to the saddle link 12 at pivot joint 16, but is not linearly movable with respect to the saddle link 12. Another front link 8 is connected to the opposite end of the saddle link 12 at a fixed pivot joint 18 having a pivot that is fixed to an end of the saddle link 12. This connection arrangement permits the front link 8 to pivot with respect to the saddle link 12 at the fixed pivot joint 18 and restricts the upper end of the front link 8 from moving along the length of the saddle link 12.

The connection of the front link 2 can both pivot and move linearly with respect to the central link 10 at the joint 26. The joint 26 is a pivotal and sliding joint that permits the lower end of the front link 2 to have the capability of pivotal movement relative to the central link 10 and to also have the capability of sliding or moving linearly with respect to the central link 10. The lower end of the front link 8 is also connected to an end portion of the central link 10 by a pivotal and sliding connection 20, thus permitting both pivotal movement and sliding or linear movement with respect to the end portion of the central link 10 to which it is connected.

All of these elements or components of the six-bar linkage mechanism of the present invention are combined to define a linkage mechanism that conforms automatically to the general orientation of the internal surface geometry of a borehole or pipe passage or spaced surfaces that define a tractored surface, and assists other systems to tractor efficiently even when non-uniform tractored surfaces are encountered.

The manner by which the six-bar linkage mechanism of the present invention functions is as follows: If the centralizer link 6 pivots around the fixed pivot joint 22, its fixed pivot joint 28 with the saddle link 12 will move toward or away from the tractored surface T depending on the direction of pivotal movement. When the fixed pivot joint 28 is located against or in close proximity with the tractored surface T, the tractored surface T constrains pivoting of the saddle link 12 to pivotal movement around the fixed pivot of the pivot joint 28. Thus, the saddle link 12 is permitted to pivotally articulate about the fixed pivot joint 28 and assumes a non-parallel or parallel relation with respect to the central link 10 by assuming the general orientation of the tractored surface T. This feature permits the six-bar linkage mechanism of the present invention to readily adapt its configuration according to the internal geometry of the tractored surface and to accommodate any irregularities of the tractored surface. When an apparatus having one or more of the six-bar linkages of the present invention is moved along the extent of a tractored surface T, the orientation of the saddle link 12 relative to the central link 10 will be changed by the reaction force of the tractored surface T, and the front links 2, 8 and centralizer links 4, 6 will move pivotally or both pivotally and linearly with respect to the central link 10, as the case may be, to accommodate orientation changes of the saddle link 12.

Figure 3:
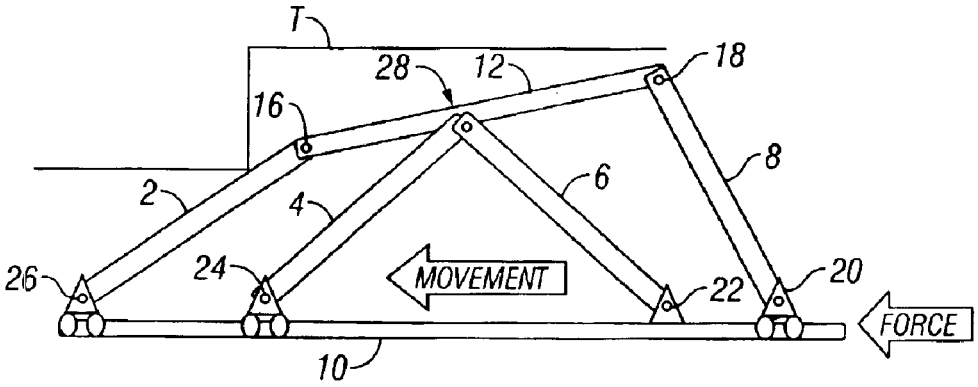
FIG. 3 is a schematic illustration showing the relative positions of the components of the invention when one of its front links is in contact with a tractored surface.

When the six-bar linkage mechanism shown in the drawings is moving along the direction of the tractored surface's longitudinal axis, one of the front links 2 or 8 may be in contact with the tractored surface T and the saddle link 12 may not contact the tractored surface T as shown in the schematic illustration of FIG. 3. During similar movement of the linkage mechanism, the saddle link 12 may be in contact with the tractored surface T and one of the front links 2 or 8 may also be in contact with the tractored surface T as evidenced by the schematic illustration of FIG. 4. When either of the front links 2 or 8 is in contact with the tractored surface T, the rest of the mechanism will change its configuration pushing the saddle link 12 and its fixed pivot joint 28 toward the central link 10 until the saddle link 12 is again in full contact with the tractored surface T and the front links 2, 8 are no longer in contact with the tractored surface T.

The schematic illustration of FIG. 3 shows how the mechanism changes its configuration when it is moving while having one of its front links 2, 8 touching the tractored surface T. In the case shown in FIG. 3, the tractored surface T is of the type found in cased wells, with the tractored surface T being defined in part by casing joints, which have surface changes of abrupt configuration and define large annular spaces that often cause other tractor mechanisms to lose traction and stall.

Figure 4:
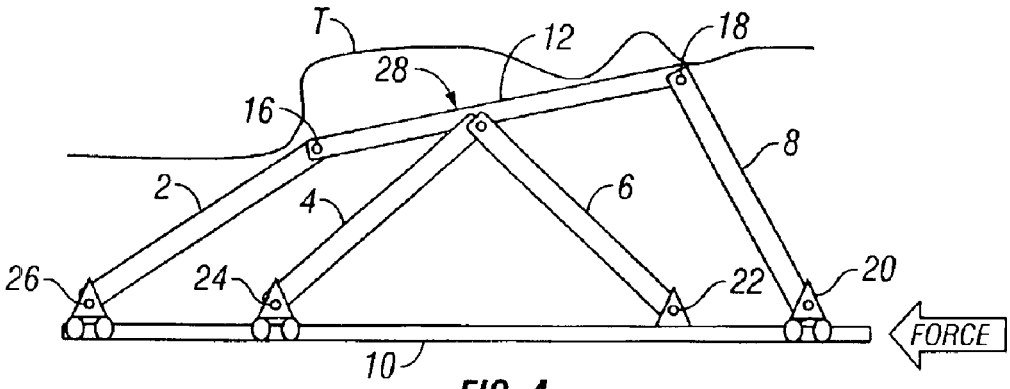
FIG. 4 is a schematic illustration showing the relative positions of the components of the invention when it is in contact with a very uneven tractored surface.
Figure 7:
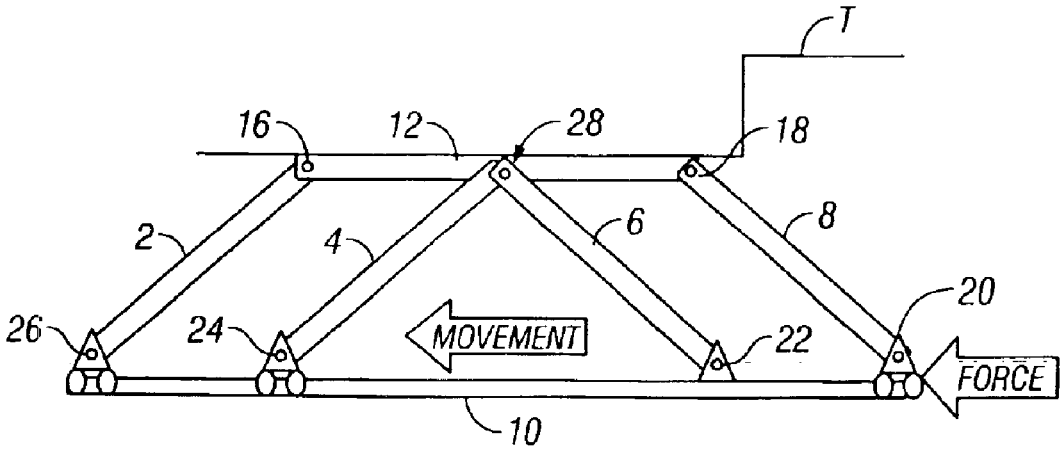
FIG. 7 is a schematic illustration showing the invention when it has just adapted its geometry after passing an obstacle in the tractored surface.

The schematic illustration of FIG. 4 shows much the same situation with respect to the tractored surface T as compared with FIG. 3, but represents a typical situation when the tractored surface T is more uneven. This is the type of tractored surface that may be found in open hole wellbores and may be caused by wandering of a drill bit during drilling or may be caused by sloughing of formation material through which the borehole extends. Contact of the saddle link 12 with the uneven configuration of the tractored surface T will cause the saddle link 12 to assume the general geometric orientation of the tractored surface T, whereupon the saddle link 12 will be disposed in non-parallel relation with the central link 10. When the front links 2, 8 of the six-bar linkage mechanism have lost contact with the non-uniform portion of the tractored surface T, and the fixed pivot joint 28 between the saddle link 12 and centralizer links 4, 6 is in contact with the tractored surface T, then the saddle link 12 will return to full contact with the tractored surface T again, thus allowing the linkage mechanism to assume the configuration shown in FIG. 7. Thus, the six-bar linkage mechanism readily adapts to the general orientation of several types of tractored surfaces and is enabled to clear internal obstacles while it translates along the longitudinal axis of the tractored surface.

Figure 5:
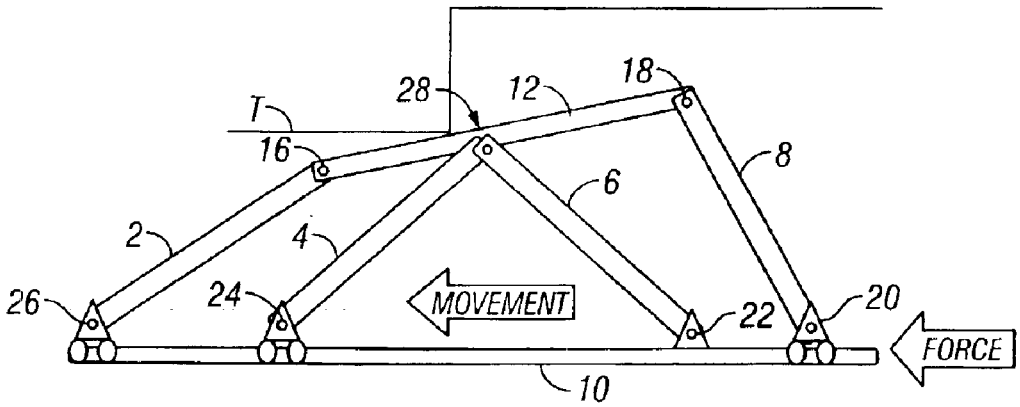
FIG. 5 is a schematic illustration showing the relative positions of the components of the invention when the saddle link of the mechanism is in contact with a tractored surface.
Figure 6:
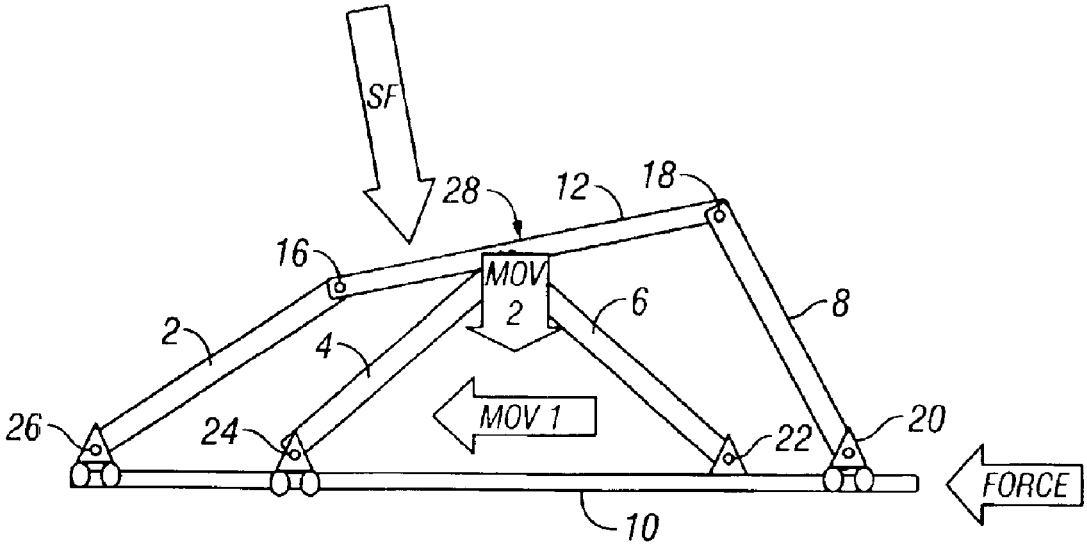
FIG. 6 is a schematic illustration showing a mechanism embodying the principles of the invention illustrating the forces and movement directions when the saddle link of the mechanism is in contact with a tractored surface.

The explanation of how the six-bar linkage mechanism of the present invention adapts its configuration to the tractored surface is as follows: When the six-bar linkage mechanism is pushed along the direction of its central link 10 and any of the front links 2 or 8 or the saddle link 12 comes in contact with the tractored surface T, the tractored surface T exerts a reaction force on the link that is in contact with it. This reaction force exerted by the tractored surface T on the six-bar linkage mechanism makes its saddle link fixed pivot joint 28 move toward the central link 10. FIGS. 5 and 6 show how a force exerted along the axis of the central link 10 makes it move in the direction of the applied force. FIG. 6 shows the interaction of forces of the case presented in FIG. 5 when the tractored surface T contacts saddle link 12. In FIG. 6, SF represents the reaction force that the tractored surface T exerts on saddle link 12 and Mov 1 represents the direction of movement of the mechanism due to the pushing force on the central link 10. Mov 2 represents the direction of movement of the fixed pivot joint 28 toward the central link 10 due to the pushing force and the reaction of the tractored surface T on saddle link 12.

Most of the time, when the mechanism moves in cased wells, the most common obstacle encountered is groove-type, with grooves usually being presented by the casing joints that connect sections of casing to form a casing string within a wellbore. In these cases, the distance between the wheel axles of a tractor employing the six-bar linkage mechanism must be chosen to be at least equal to the width of the grooves found in the tractored surface. Sometimes, the tractored surface can present abrupt changes in internal diameter. In the oil business, these are usually found in the restrictions of well casings due to reducing collars or connectors that couple casing sections of differing diameter. In order to overcome these obstacles, the length of the saddle link 12 must be maximized within the dimensional limits presented by the tractor or tool design that is utilizing the six-bar mechanism.

Figure 8:
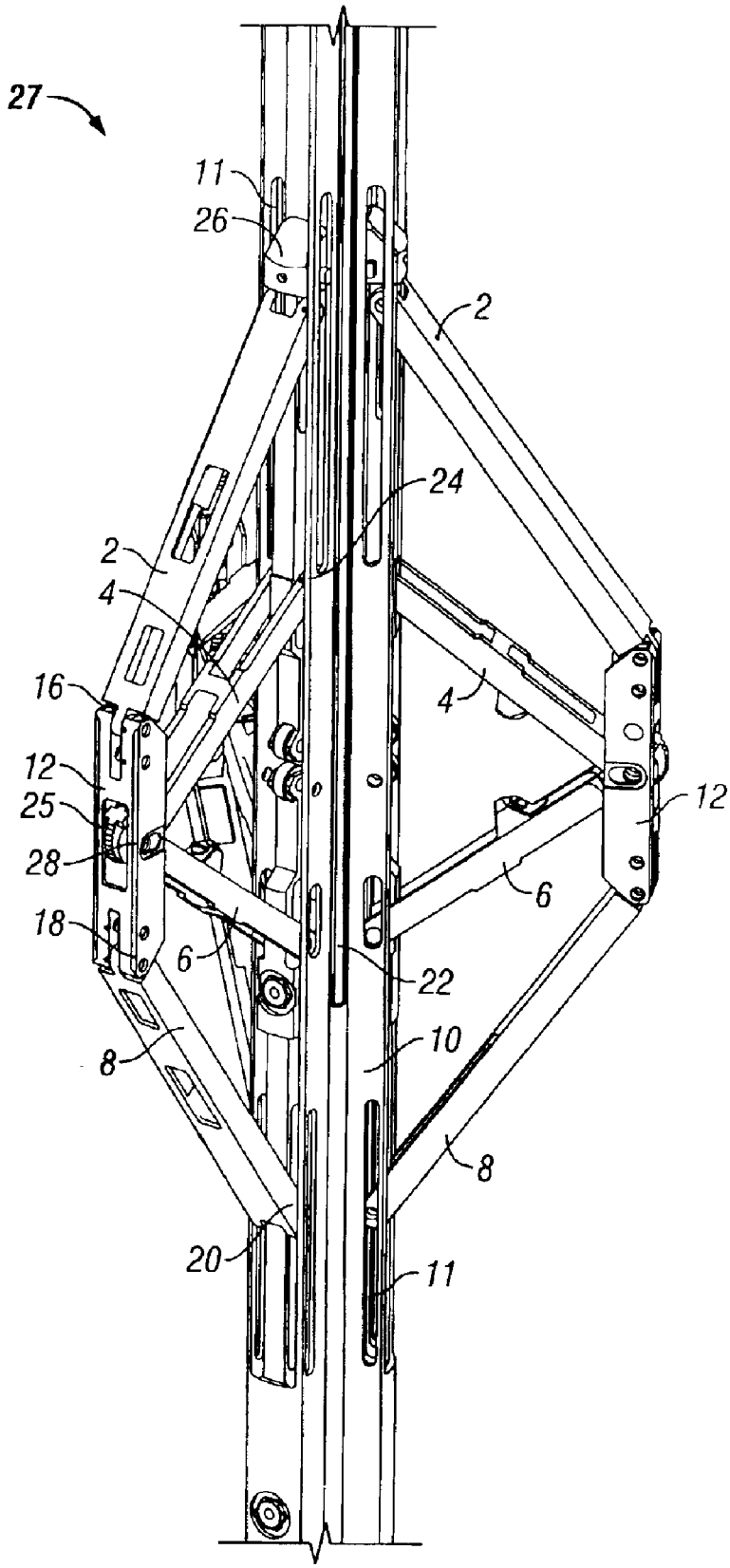
FIG. 8 is a three dimensional illustration of an embodiment employing the principles of the invention in the form of a well tractor tool grip mechanism.

Referring now to FIG. 8, there is shown an embodiment of the present invention in the form of a tractor mechanism, shown generally at 27, for use within wellbores and well pipe. Such a tractor mechanism is especially useful when objects such as logging tools and other well tools are to be moved through highly deviated or horizontal well sections, where gravity assistance is not available or has minimal effect. In the tractor embodiment 27 shown in FIG. 8, the various links and joints of each of the radiating surface engaging mechanisms are identified by corresponding reference numerals in the same manner as in FIG. 2. The tractor mechanism embodiment of FIG. 8 is shown to have three tractored surface engaging six-bar linkage mechanisms embodying the principles of the present invention located around a central body of the tractor tool 27 at an angular spacing of 120 degrees apart from each other. The central body of the tool 27 defines a central link or tractor body 10 of a six-bar linkage and defines a plurality of linear movement guides or tracks 11, shown in the form of guide slots, to provide for guided linear movement of sliding pivot joints. The guide slots 11 are each oriented substantially parallel to the longitudinal axis of the tractor body 10 so that each of the movable pivot joints is linearly movable in parallel relation with the longitudinal axis of the tractor body 10. It should be noted that a short guide slot is provided at the fixed pivot joint 22 to allow for a small amount of sliding movement at the connection to prevent binding of the mechanism.

It should be borne in mind that this particular embodiment is not intended to limit the scope of the present invention in any manner whatever. Embodiments having a lesser or greater number of tractored surface engaging mechanisms may be employed as well. In the embodiment shown, the saddle links 12 of each of the six-bar linkages incorporates a wheel 25 that is positioned for engagement with the tractored surface. This wheel may simply be a rotary element that is mounted for rotation by the fixed pivot joint 28 that connects the centralizer links 4 and 6 with the saddle link 12. Alternatively, the wheel 25 may be a traction wheel that is rotatably driven in any suitable manner, such as by a tractor motor. Another embodiment may have wheels on both ends of the saddle link 12 to facilitate the sliding of the saddle link 12 while moving in contact with the tractored surface.

It is important to emphasize that the dimensioning of the front links 2 and 8, the saddle link 12, and the position of the fixed pivot joint 28 on saddle link 12 define the external force that is required to make the mechanism move in the direction of the longitudinal axis of the tractored surface. In general terms, the ratio between the length of the front link 2 (L1) to the length of centralizer link 4 (L2) defines the magnitude of the external force required to push the mechanism inside any given tractored surface. Another ratio that defines the performance of this mechanism is the ratio of the distance between joints 16 and 28 called L4 and the distance between the joint 28 and the joint 18 called L5. The best performance to overcome restrictions, for example, is achieved when the ratio L1/L2 is maximized and the ratio L4/L5 is minimized.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the scope of the invention as defined by the appended claims.

What is claimed is:

1. A linkage mechanism for substantially conforming to the configuration of at least one adjacent surface and maintaining contact therewith, comprising:

a central link;

a saddle link disposed in spaced relation with said central link and disposed for contact with said at least one adjacent surface;

first and second front links each having pivotal connection with said saddle link and having linearly movable pivotal connection with said central link at spaced locations; and first and second centralizer links each having pivotal connection with said saddle link, said first centralizer link having linearly movable pivotal connection with said central link and said second centralizer link having pivotal connection with said central link.

2. The linkage mechanism of claim 1, wherein:

said central link has first and second ends; and said first and second front links each have ends establishing connection with respective first and second ends of said central link.

3. The linkage mechanism of claim 1, further comprising:

a central pivot establishing said pivotal connection of said first and second centralizer links with said saddle link at an intermediate location thereon.

4. The linkage mechanism of claim 1, further comprising:

an elongate guide track defined by said central link; and wherein said linearly movable pivotal connections of said first and second front links and said first centralizer link have guided engagement with said elongate guide track and are linearly movable thereon for angulated orientation and positioning of said front links and said centralizer links.

5. The linkage mechanism of claim 1, wherein:

said central link has first and second ends;

said first and second front links each have ends establishing connection with respective first and second ends of said central link; and a central pivot establishes said pivotal connection of said first and second centralizer links with said saddle link at an intermediate location thereon.

6. The linkage mechanism of claim 1, wherein:

said central link, saddle link, first and second front links and said centralizer links are each of substantially straight configuration; and said pivotal connections of said first and second front links and said centralizer links with said central link are oriented along a line in parallel relation with said central link.

7. A linkage mechanism for substantially conforming to the configuration of at least one adjacent surface and maintaining contact therewith, comprising:

a central link;

a saddle link disposed in spaced relation with said central link for contact with the adjacent surface and having variable angular and spacing relationship with said central link by force of geometric changes encountered during movement of said saddle link along the adjacent surface;

a pair of front links each having pivotal connection with said saddle link and having linearly movable pivotal connection with said central link and assuming positions responsive to angular and spacing changes of said saddle link relative to said central link; and a pair of centralizer links located between said front links and having pivotal connections with said saddle link and first and second pivotal connections with said central link, said first pivotal connection being linearly movable on said central link.

8. The linkage mechanism of claim 7, wherein:

said central link has first and second ends;

said front links each have ends establishing connection with respective first and second ends of said central link.

9. The linkage mechanism of claim 7, further comprising:

a central pivot establishing said pivotal connections of said pair of centralizer links with said saddle link at an intermediate location thereon.

10. The linkage mechanism of claim 7, further comprising:

an elongate guide track defined by said central link; and wherein said linearly movable pivotal connections of said pair of front links and said first pivotal connection of said pair of centralizer links have guided engagement with said elongate guide track and are linearly movable thereon for angulated orientation and positioning of said front links and said centralizer links.

11. The linkage mechanism of claim 7, wherein:

said central link, saddle link, front links, and said centralizer links are each of substantially straight configuration; and said pivotal connections of said front links and said centralizer links with said central link are oriented along a line in parallel relation with said central link.

12. A tractor mechanism for engagement with a tractored surface, comprising:

a tractor body defining a central link;

a plurality of tractored surface engaging mechanisms mounted to and radiating from said tractor body and angularly spaced around said tractor body, each of said plurality of tractored surface engaging mechanisms comprising:

a saddle link disposed in spaced relation with said tractor body and disposed for contact with the tractored surface;

first and second front links each having pivotal connection with said saddle link and having linearly movable pivotal connection with said tractor body at spaced locations;

first and second centralizer links each having pivotal connection with said saddle link, said first centralizer link having linearly movable pivotal connection with said tractor body and said second centralizer link having pivotal connection with said tractor body; and wherein said saddle link is movable responsive to reaction force of the tractored surface to assume angular orientation with respect to said tractor body and substantially conform to the tractored surface.

13. The tractor mechanism of claim 12, further comprising:

at least one wheel rotatably mounted to each of said saddle links and disposed for engagement with the tractored surface.

14. The tractor mechanism of claim 12, wherein:

said tractor body defines at least one linear movement guide;

said linearly movable pivotal connections establish movable connection of said front links and said first centralizer link with said at least one linear movement guide; and said second centralizer link has a fixed pivotal connection with said tractor body.

15. The tractor mechanism of claim 12, wherein:

each of said tractor surface engaging mechanisms is independently movable by reaction force of the tractored surface.

16. The tractor mechanism of claim 12, further comprising:

a single pivot connecting said first and second centralizer links intermediate said saddle link for pivotal movment of said saddle link about said single pivot.

17. The tractor mechanism of claim 13, wherein said at least one wheel is motor-driven.

18. The tractor mechanism of claim 12, wherein the tractored surface is a casing string within a wellbore.

19. The tractor mechanism of claim 12, wherein the tractored surface is a open-hole wellbore.

20. The tractor mechanism of claim 12, wherein the tractored surface comprises casing string and open-hole wellbore, said saddle link being movable responsive to both the casing string and open-hole wellbore.

* * * * *